United States Patent [19]

Eckstein

[11] Patent Number: 4,701,185

[45] Date of Patent: Oct. 20, 1987

[54] PROCESS FOR SEPARATING FLY-ASH

[75] Inventor: Günter K. Eckstein, Hamburg, Fed. Rep. of Germany

[73] Assignee: Shell Oil Company, Houston, Tex.

[21] Appl. No.: 726,950

[22] Filed: Apr. 26, 1985

Related U.S. Application Data

[63] Continuation of Ser. No. 493,185, May 10, 1983, abandoned.

[30] Foreign Application Priority Data

May 10, 1982 [DE] Fed. Rep. of Germany ..... 3217483

[51] Int. Cl.[4] ..... C10K 1/02; B01D 45/16; B65G 53/14

[52] U.S. Cl. ..... 48/197 R; 55/1/431; 252/373; 406/141

[58] Field of Search ..... 48/197 R, 69, 87, DIG. 2, 48/DIG. 4; 110/165 A, 171, 210, 211, 216; 406/141; 165/163; 75/25; 55/1, 428, 431

[56] References Cited

U.S. PATENT DOCUMENTS

| | | | |
|---|---|---|---|
| 2,370,207 | 2/1945 | Thorsten et al. | 110/171 |
| 2,879,148 | 3/1959 | Atwell | 48/DIG. 2 |
| 3,788,281 | 1/1974 | Van Lookeren Champagne | 165/163 |

FOREIGN PATENT DOCUMENTS

| | | | |
|---|---|---|---|
| 686140 | 5/1964 | Canada | 406/141 |
| 1182594 | 11/1964 | Fed. Rep. of Germany | 406/141 |
| 2729764 | 1/1979 | Fed. Rep. of Germany . | |

OTHER PUBLICATIONS

Perry et al., Chemical Engineering Handbook, 5th edition, 1973, pp. 5–45 and 5–46.

*Primary Examiner*—Barry S. Richman
*Assistant Examiner*—Joye L. Woodard

[57] ABSTRACT

Process for depressurizing fly-ash being contained in a first vessel comprising a pressurized gas by expanding the gas through at least one long and narrow pipe. The inlet of the pipe(s) dips under the upper level of the fly-ash in the first vessel. The outlet of the pipe(s) is situated in a second vessel being kept at a relatively low pressure. The gas flow through the pipe(s) entrains the fly-ash.

8 Claims, 1 Drawing Figure

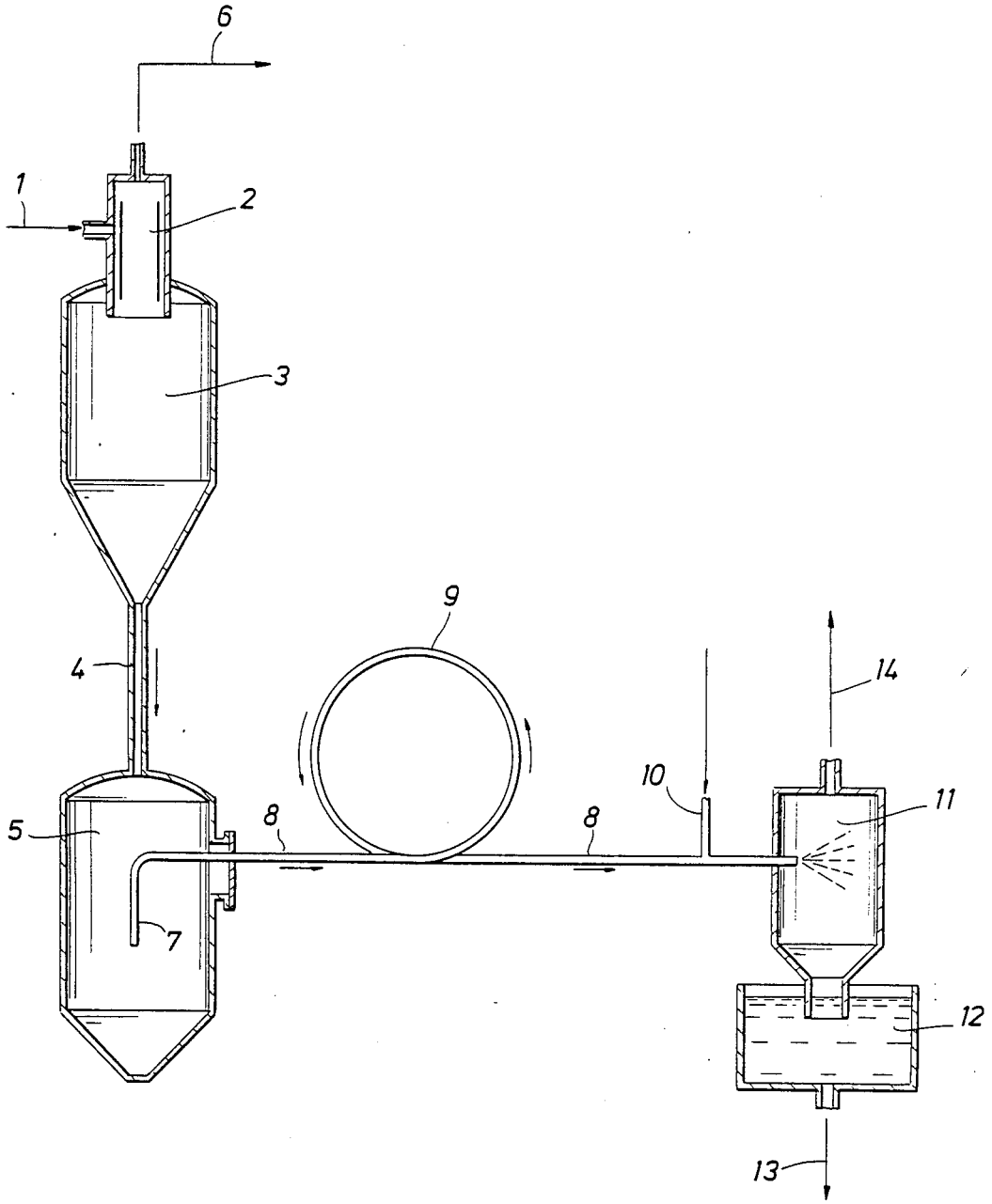
6
1
2
3
4
5
7
8
8
9
10
11
12
13
14

PROCESS FOR SEPARATING FLY-ASH

This is a continuation of application Ser. No. 493,185, filed May 10, 1983, now abandoned.

FIELD OF THE INVENTION

The invention relates to a process for depressurizing fly-ash being contained in a vessel comprising a pressurized gas.

BACKGROUND OF THE INVENTION

Fly-ash is usually obtained by separation from gas resulting from the partial or complete burning of carbonaceous material such as coal. It is usually composed of particles having a diameter in the range from 0.1 to 200 μm. If the burning is carried out at elevated pressure it is practice to clean the resulting gas at about the same pressure so that the separated fly-ash is caught in a pressurized vessel.

In order to be able to transport, work up or dump the fly-ash it should generally be depressurized.

Studies on the depressurizing of fly-ash by means of lock hopper systems have shown that the valves between the lock hoppers wear out rather quickly.

It has now been found that this problem can be solved by depressurizing the fly-ash by means of a relatively long and narrow pipe.

SUMMARY OF THE INVENTION

The invention therefore relates to a process for depressurizing fly-ash being contained in a first vessel comprising a pressurized gas, characterized in that the pressurized gas is expanded through at least one long and narrow pipe, the inlet of which dips under the upper level of the fly-ash in the first vessel and the outlet of which is situated in a second vessel being kept at a relatively low pressure, the gas flow through the pipe(s) entraining the fly-ash.

BRIEF DESCRIPTION OF THE DRAWING

The drawing is a simplified flow diagram of the present process.

DESCRIPTION OF THE PREFERRED EMBODIMENT

Although the fly-ash can be depressurized by the present process for any high pressure to any low pressure, the pressure in the first vessel is preferably in the range from 5 to 40 bar since at such a pressure partial combination of coal for the production of synthesis gas is advantageously carried out.

The pressure in the second vessel is preferably in the range from 5 to 40 bar since at this pressure the fly-ash can conveniently be further transported, worked up or dumped.

Dependent on the pressure drop that has to be effected and the amount and the nature of fly-ash that has to be depressurized, the length, the diameter and the number of the pipes have to be chosen.

For the reduction in pressure from 30 to 1 bar of 250 kg/h fly-ash preferably a pipe having a length in the range from 1 to 20 m and an internal diameter in the range from 5 to 50 mm is applied.

For different pressure drops, and amounts of fly-ash the suitable lengths and diameters of the pipe(s) preferably to be used can be calculated or experimentally be established.

Since fly-ash is a very erosive material being predominantly composed of metal silicates, according to a preferred embodiment of the present invention the pipe(s) is(are) internally covered with an abrasionresistant material, such as tungsten carbide, the pipe(s) themselves having preferably been made of steel.

Since for a suitable reduction in pressure the pipe(s) is(are) rather long it is preferred to coil it(them). Moreover, by such coiling the resistance of the pipe(s) is advantageously increased leading to a greater pressure drop or, if desired, to the possibility of using a shorter pipe length.

Preferably, the pipe(s) contains(contain) 1 to 10 coils, having an external diameter in the range from 1 to 3 m.

Since large particles in the fly-ash to be reduced in pressure could lead to blocking of comparatively narrow pipe(s), the inlet of pipe(s) preferably contains a sieve the openings of which are in the range from 1 to 5 mm.

In this way blocking of pipe(s) is effectively obviated.

As has been described hereinbefore, during the depressurizing process the fly-ash is transported by an expanding gas from a first vessel kept at a relatively high pressure to a second vessel kept at a relatively low pressure.

These vessels suitably have about the same cubic content. Therefore, the top of the second vessel is advantageously connected with a line for removing depressurized gas from this vessel.

In order to remove the depressurized fly-ash from the second vessel this vessel is suitably connected with means, such as a "Zellenradschleuse", for the removal of the fly-ash.

Moreover, the second vessel is advantgeously equipped with means for fluidizing the fly-ash contained therein because fluidized fly-ash can be more smoothly withdrawn from the vessel than fly-ash which lies still on the bottom of the vessel.

When the fly-ash is a by-product in the production of synthesis gas by partial combustion of carbonaceous material at an elevated pressure it is generally separated from the bulk of the synthesis gas by means of at lest one cyclone. So it is caught in the first vessel being surrounded by a synthesis gas atmosphere. Therefore, in that case the pressurized gas suitably consists of synthesis gas and the fly-ash is depressurized by expanding this synthesis gas through the relatively long and narrow pipe(s).

The expanded synthesis gas is then received in the second vessel being kept at a relatively low pressure and as mentioned hereinbefore is can be withdrawn from this vessel through a suitable line so as to blend it with the bulk of the synthesis gas separated in the cyclone(s).

According to a more preferred embodiment of the present process the expanded synthesis gas is, however, burned at the outlet of the expansion pipe(s), oxygen, air or oxygen-enriched air being injected therein through at least one additional pipe so that the fly-ash contained in this synthesis gas is molten. The molten fly-ash is preferably caught in a water bath situated in the bottom of the second vessel, where it solidifies quickly. In this manner glass-like pearl-shaped slag marbles or granules are formed which can be easily removed from the water bath, e.g., by means of a "Zellenradschleuse". These slag marbles are not leachable by rain water or ground water and can therefore be easily dumped or used in road construction without danger of contaminating the environment with heavy metals present in the original fly-ash.

Fly-ash often contains carbon resulting from an incomplete combustion of the carbonaceous material to be converted into synthesis gas. This carbon is also burned during the combustion of the expanded synthesis gas at the outlet of the expansion piep(s), thereby generating an additional quantity of hed which is used in the melting of the fly-ash.

The invention will now be further illustrated by means of the accompanying drawing which is a simplified flow diagram of the present process. The invention is by no means restricted to such drawing which gives only a schematic overview of the equipment used in the process according to the invention with the valves, pumps, compressors, control and measurement instruments and the like being omitted from this drawing for the sake of convenience.

Through a line 1 a fly-ash-containing stream of synthesis gas is passed at a pressure of about 28 bar to a cyclone 2. In the cyclone 2 the bulk of the fly-ash is separated from the bulk of the synthesis gas. The former falls into a vessel 3 and further through a line 4 into a vessel 5. The latter is passed through a line 6 to a cleaning system (not shown). Via a dip pipe 7 the fly-ash is passed into expansion pipe 8 comprising a coil 9 with an external diameter of about 3 m. The length of the total expansion pipe is about 15 m and its smallest internal diameter is about 7 mm. Via a line 10 sufficient oxygen is injected into the expanded fly-ash-containing synthesis gas stream in line 8 to burn the synthesis gas and possible coke present on the fly-ash at the end of line 8 in vessel 11, which is operated at about atmospheric pressure. By the heat generated in the vessel 11 the fly-ash melts and the molten fly-ash falls down into a water bath 12 where it solidifies in the form of pearl-shaped granules with a diameter in the range from 0.3 to 20 mm which are removed from the system via a line 13. Flue gas generated in the burning is transferred via a line 14 to a stack (not shown).

What is claimed is:

1. A process comprising separating fly-ash and a minor portion of synthesis gas from a fly-ash-containing stream of synthesis gas at relatively high pressure, collecting said fly-ash and recovering said minor portion of synthesis gas in a first vessel at relatively high pressure, expanding recovered pressurized synthesis gas in said first vessel through at least one long and narrow pipe, the inlet of which dips under the upper level of the fly-ash collected in the first vessel and the outlet of which is situated in a second vessel at a relatively low pressure, the gas flow through the pipe or pipes entraining the fly-ash.

2. The process of claim 1 wherein the pressure in the first vessel is from 5 to 40 bar.

3. The process of claim 2 wherein the inlet of the pipe contains a sieve or the inlets of the pipes contain sieves, the openings of which sieve or sieves are in the range from 1 to 5 mm.

4. The process of claim 2 wherein the expanded synthesis gas is burned and the flyash is molten at the outlet of the pipe or pipes in the second vessel, the molten flyash being caught in a water bath situated in the bottom of the second vessel.

5. The process of claim 2 wherein the pipe or pipes are internally covered with an abrasion-resistant material.

6. The process of claim 5 wherein the flyash is fluidized in the second vessel.

7. The process of claim 5 wherein the pipe is coiled and contains 1 to 10 coils.

8. The process of claim 7 wherein the coil or coils are from 1 to 3 meters in external diameter.

* * * * *